US008441222B2

(12) United States Patent
Manzarek et al.

(10) Patent No.: US 8,441,222 B2
(45) Date of Patent: May 14, 2013

(54) SYSTEM AND METHOD FOR DETERMINING PUMP PRESSURE BASED ON MOTOR CURRENT

(75) Inventors: Donovan Keith Manzarek, Sanger, TX (US); John Laessle, Plano, TX (US); John Charles Vines, Dallas, TX (US)

(73) Assignee: Integrated Designs, L.P., Carrollton, TX (US)

( * ) Notice: Subject to any disclaimer, the term of this patent is extended or adjusted under 35 U.S.C. 154(b) by 338 days.

(21) Appl. No.: 12/836,038

(22) Filed: Jul. 14, 2010

(65) Prior Publication Data

US 2011/0030484 A1 Feb. 10, 2011

Related U.S. Application Data

(60) Provisional application No. 61/225,896, filed on Jul. 15, 2009.

(51) Int. Cl.
*G05F 1/10* (2006.01)

(52) U.S. Cl.
USPC ..... 318/650; 318/443; 318/477; 417/31; 417/4; 417/19; 417/20; 417/22; 700/282; 700/275; 700/1; 700/12; 700/25; 702/34

(58) Field of Classification Search ..... 318/650, 318/453, 474; 700/282; 702/34; 73/152.23, 73/152.29, 152.37, 152.27, 37, 861.43, 700, 73/717
See application file for complete search history.

(56) References Cited

U.S. PATENT DOCUMENTS 4,237,451 A * 12/1980 Hollenbeck ..... 340/606
4,710,686 A 12/1987 Guzik
4,713,619 A 12/1987 Busso et al.
5,006,044 A * 4/1991 Walker et al. ..... 417/12
5,063,775 A * 11/1991 Walker et al. ..... 73/152.31
5,222,867 A * 6/1993 Walker et al. ..... 417/12
5,295,737 A * 3/1994 Epple et al. ..... 303/11
5,319,572 A * 6/1994 Wilhelm et al. ..... 702/51
5,646,520 A 7/1997 Frank et al.
5,703,490 A 12/1997 Kennedy (Continued)

FOREIGN PATENT DOCUMENTS

EP 1 826 408 * 8/2007
EP 1 826 408 A2 8/2007

OTHER PUBLICATIONS

International Search Report for PCT/US2010/042000 mailed Nov. 18, 2010.

*Primary Examiner* — Rita Leykin
(74) *Attorney, Agent, or Firm* — Caesar, Rivise, Bernstein, Cohen & Pokotilow, Ltd.

(57) ABSTRACT

A system for measuring current in an H-Bridge motor drive circuit and using that current to determine the output of a device powered by the motor. A particular embodiment is disclosed for a motor-driven fluid pump. Motor current is measured at predetermined pump pressures and flow rates to create calibration tables relating motor current to pump pressure. Once calibrated, the system determines pump pressure based on motor current by referring to the calibration tables. In an embodiment, the pump is driven to achieve a predetermined fluid dispense profile. The system monitors pump pressure by measuring motor current and determines if the dispense profile is being achieved and sets alarms if predetermined thresholds are not maintained. The system also detects pump wear based on the current measurements and issues warnings to the user in such conditions.

5 Claims, 9 Drawing Sheets

U.S. PATENT DOCUMENTS 5,719,519 A * 2/1998 Berringer ..... 327/423
5,874,818 A 2/1999 Schuurman
5,967,253 A 10/1999 Collier-Hallman
6,092,618 A 7/2000 Collier-Hallman
6,453,878 B1 9/2002 Mazet
6,529,796 B1 * 3/2003 Kroeger et al. ..... 700/202
6,577,089 B1 * 6/2003 Piedl et al. ..... 318/432
6,739,840 B2 5/2004 Curry et al.
7,668,694 B2 * 2/2010 Anderson et al. ..... 702/182
7,689,368 B2 * 3/2010 Douglas ..... 702/33
7,798,781 B2 * 9/2010 Parsons et al. ..... 417/20
2006/0145651 A1 7/2006 Sullivan
2007/0128046 A1 6/2007 Gonnella et al.
2007/0128047 A1 6/2007 Gonnella et al.
2009/0220352 A1 * 9/2009 Carstensen ..... 417/44.11
2011/0008179 A1 * 1/2011 Turner et al. ..... 417/53
2012/0001762 A1 * 1/2012 Turner et al. ..... 340/626

* cited by examiner

SYSTEM AND METHOD FOR DETERMINING PUMP PRESSURE BASED ON MOTOR CURRENT

CROSS-REFERENCE TO RELATED APPLICATIONS

This utility application claims the benefit under 35 U.S.C. §119(e) of Provisional Application Ser. No. 61/225,896 filed on Jul. 15, 2009 and entitled System and Method for Determining Pump Pressure Based on Motor Current, the entire disclosure of which is incorporated by reference herein

FIELD OF THE INVENTION

The invention relates generally to the field of measurement of output of electric motors. The invention relates more specifically to measurement of output of stepper motors driven by H-bridge circuitry.

BACKGROUND OF THE INVENTION

In the fluid dispensing arts, it is desirable to know fluid pressure. Conventionally, this is done with dedicated pressure sensors. In some cases it may not be practical to have a pressure sensor in the system, whether due to prohibitive cost of the sensor, reliability, pressure levels, fluid temperature, or the environment in which the system is operating. It is known to use current of an electric motor that is driving a pump to estimate pump pressure. This is possible because motor current is predictably related to output torque and the torque required to drive a pump is related to pump pressure. Example publications in this area include: U.S. Pat. Nos. 5,967,253; 6,092,618; 6,453,878; 6,577,089; 6,739,840 and U.S. Patent Application Pub. no. 2006/0145651. All references cited herein are incorporated by reference. The present invention provides an improvement in this field in that it provides highly accurate pressure indications based on current measurements for an H-bridge stepper motor controller.

DESCRIPTION OF THE PREFERRED EMBODIMENT OF THE INVENTION

The embodiment described below is for determining pump pressure based on motor current in an H-bridge driver circuit for a stepper motor. The invention is not limited to motor-driven pumps, however. The invention is applicable to any motor-driven device whose mechanical output is related to torque driven by the motor. An example of another application is determination of weight of a load lifted by a motor driven shaft.

Current Sense Signal Conditioning and Measurement

Figure 1:
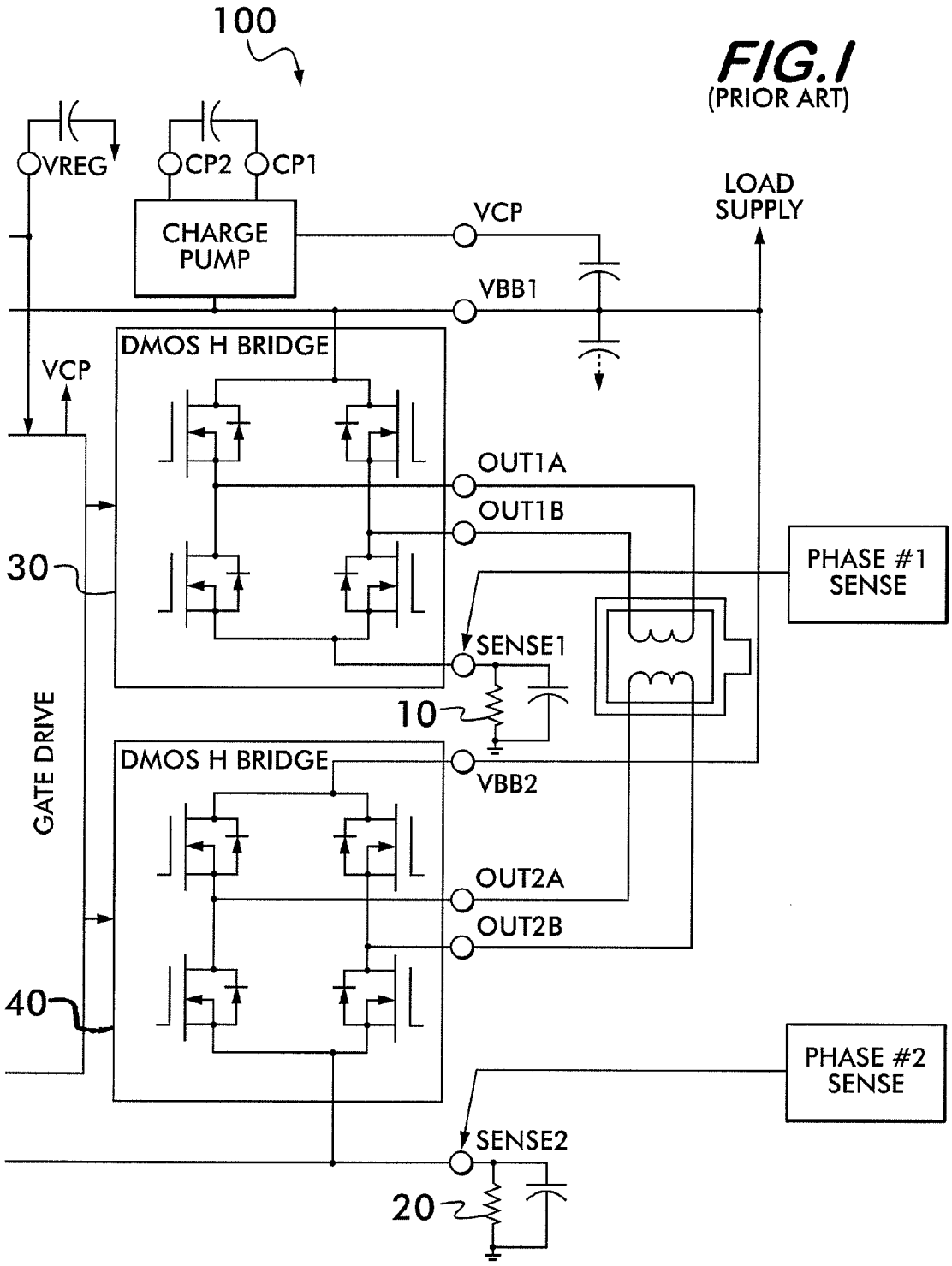
FIG.1 (PRIOR ART)
FIG. 1 is a schematic diagram of a prior art stepper motor H-bridge driver circuit.
Figure 2:
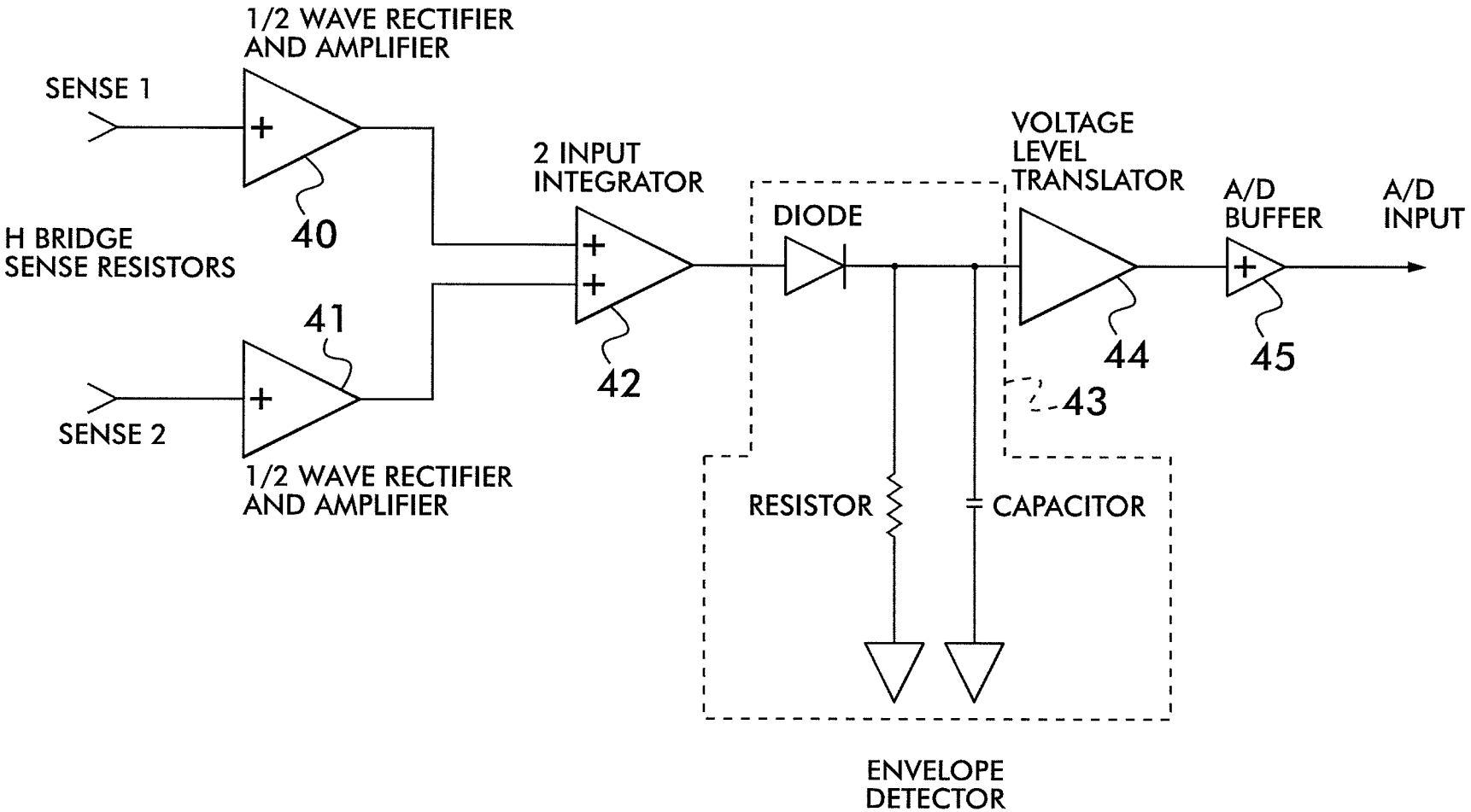
FIG. 2 is a block diagram of a circuit for measuring motor current from H-bridge sense resistors.
Figure 3:
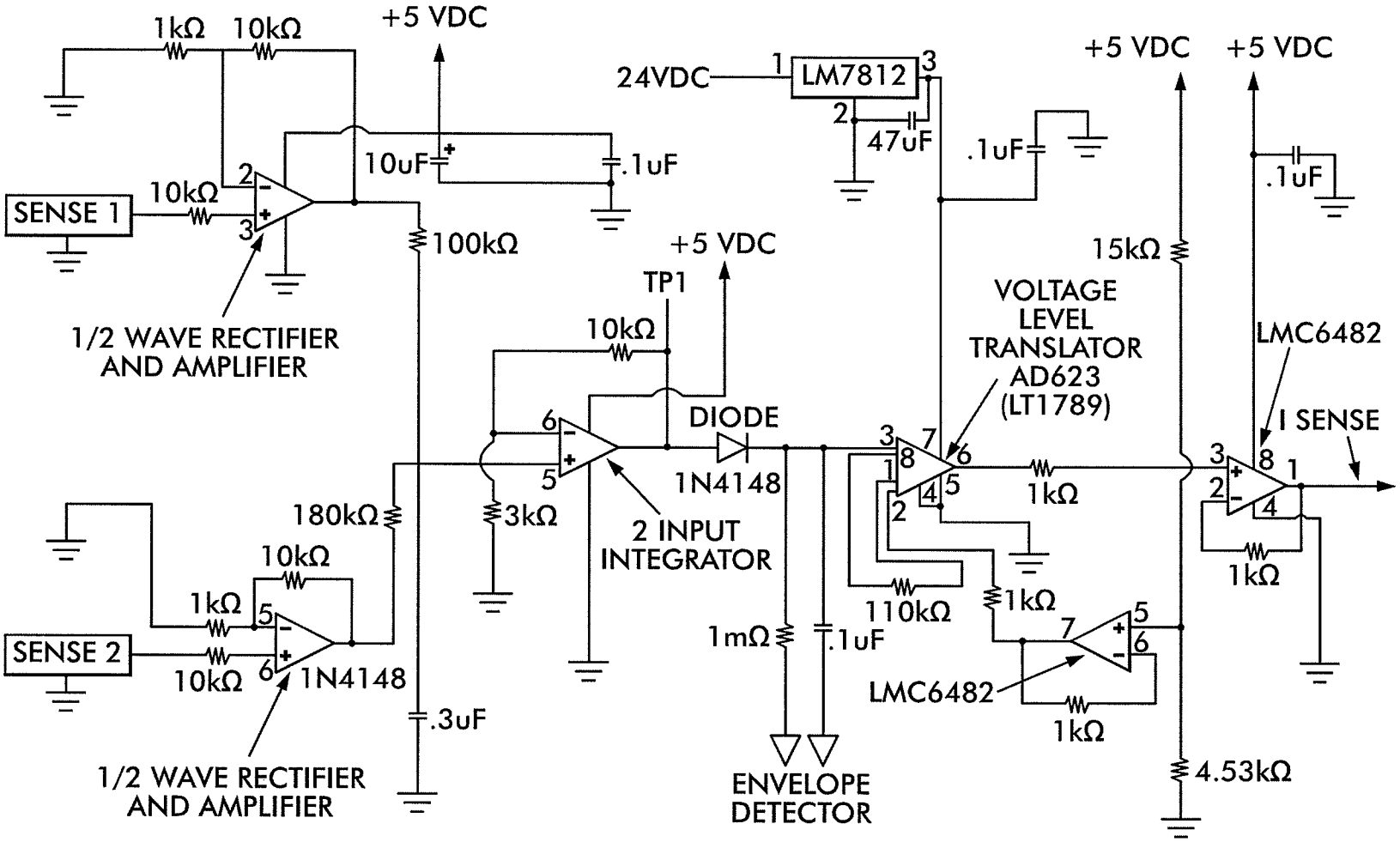
FIG. 3 is a schematic diagram of a circuit for measuring motor current from H-bridge sense resistors.

FIG. 1 is a schematic for a prior art H-bridge two phase stepper motor drive circuit 100, noting the Phase 1 and Phase 2 sense resistors 10, 20 in the ground path of the H-bridge DMOS FETS 30, 40. Motor current is sensed by the voltage drop across these resistors. This technique is known in the art. Publications in this area include: U.S. Pat. Nos. 4,710,686; 5,646,520; 5,703,490 and 5,874,818. FIG. 2 is a block diagram of an embodiment of the invention showing a signal conditioning circuit for the measurement of the motor current from the sense resistors in FIG. 1 by an analog to digital converter. As shown in FIG. 2, each motor drive phase is rectified by a half wave active rectifier 40, 41. The rectified signals are summed and integrated by a two input integrator 42. An envelope detector 43 is used to remove signal noise. The signal is then DC amplified and voltage translated 44 to maximize the signal level that is read by the A/D converter. In other words, the signal is level shifted and amplified so that the expected dynamic range is commensurate with the input range of the A/D converter to allow use of the maximum resolution of the converter. The signal is buffered by a buffer amplifier 45 before driving the A/D converter. FIG. 3 is a detailed circuit implementation of the conditioning circuit of FIG. 2.

Derivation of Pump Pressure Model from Motor Current

In an embodiment of the invention, comprising a motor and a fluid pump, the relationship between pump pressure and motor current is established through a look-up table. The look-up table is used to expedite data processing and because the relationship between the pressure and current is not a continuous function. In an embodiment wherein pumping occurs over a predetermined time period, a calibration process is performed whereby for a predetermined pump flow rate, a data set of motor current values is measured and stored for a discrete number of sample periods during the pumping process. In FIGS. 4-6, 1250 current measurements are made for each pump flow rate.

Figure 4:
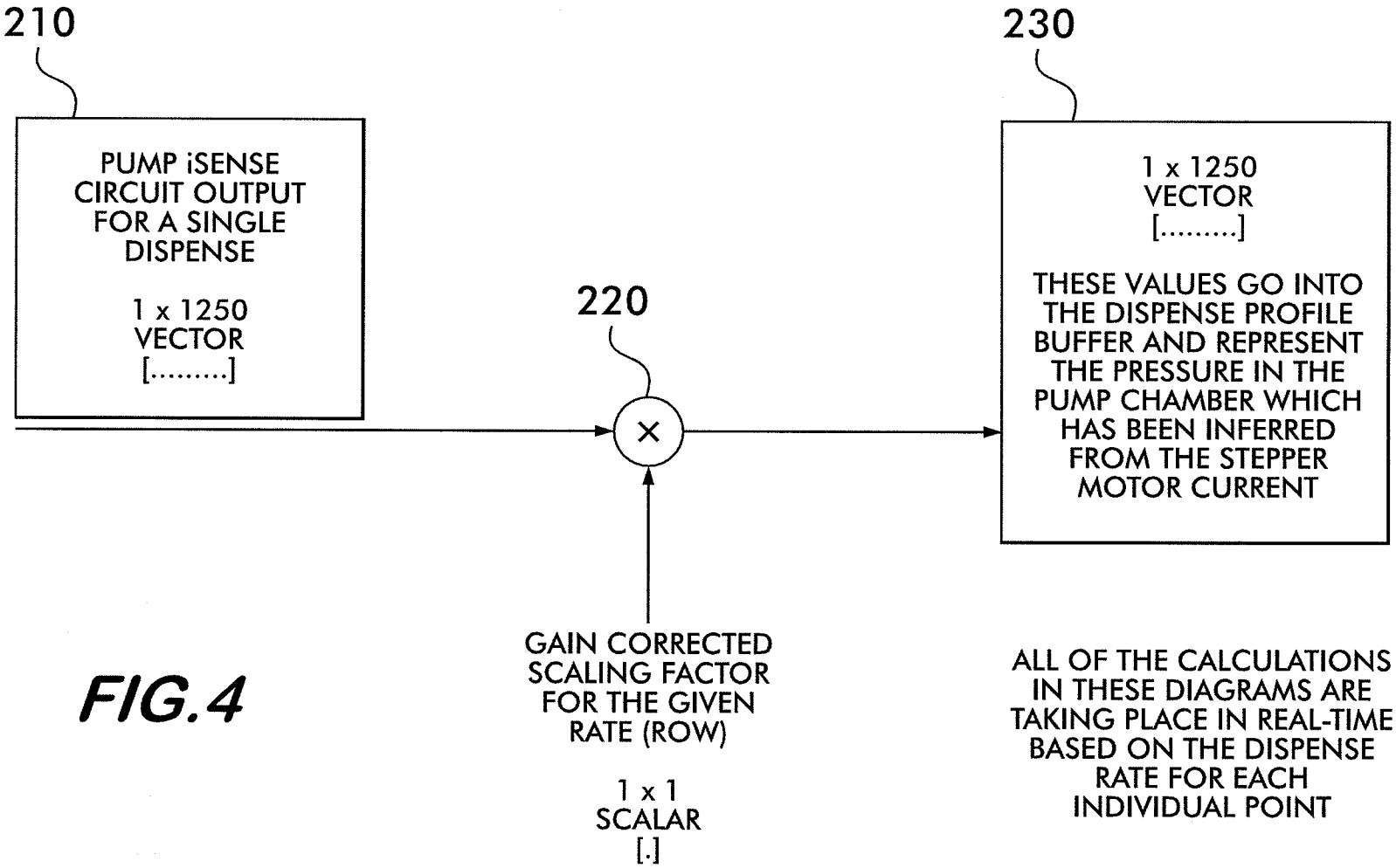
FIG. 4 is a flow diagram for deriving pump pressure from motor current.

FIG. 4 shows a flow diagram for scaling motor current data with gain corrected scaling factor for a given pump rate to produce a pressure profile for a single dispense rate. In an embodiment, a pump dispenses fluid in a predetermined process having a predetermined time frame. In the embodiment depicted, at step 210, 1250 current measurements are made in the dispense time frame. At step 220, each of the current measurements is scaled by the gain-corrected scaling factor and 1250 corresponding pump pressures are generated. A table of scale factors is used to determine the proper scale factor for the pump flow rate. At step 230, each of the scaled current measurements is loaded into a dispense profile buffer. All of the calculations in FIGS. 4-7 are performed in real time and are based on the dispense rate for each individual data point.

Figure 5:
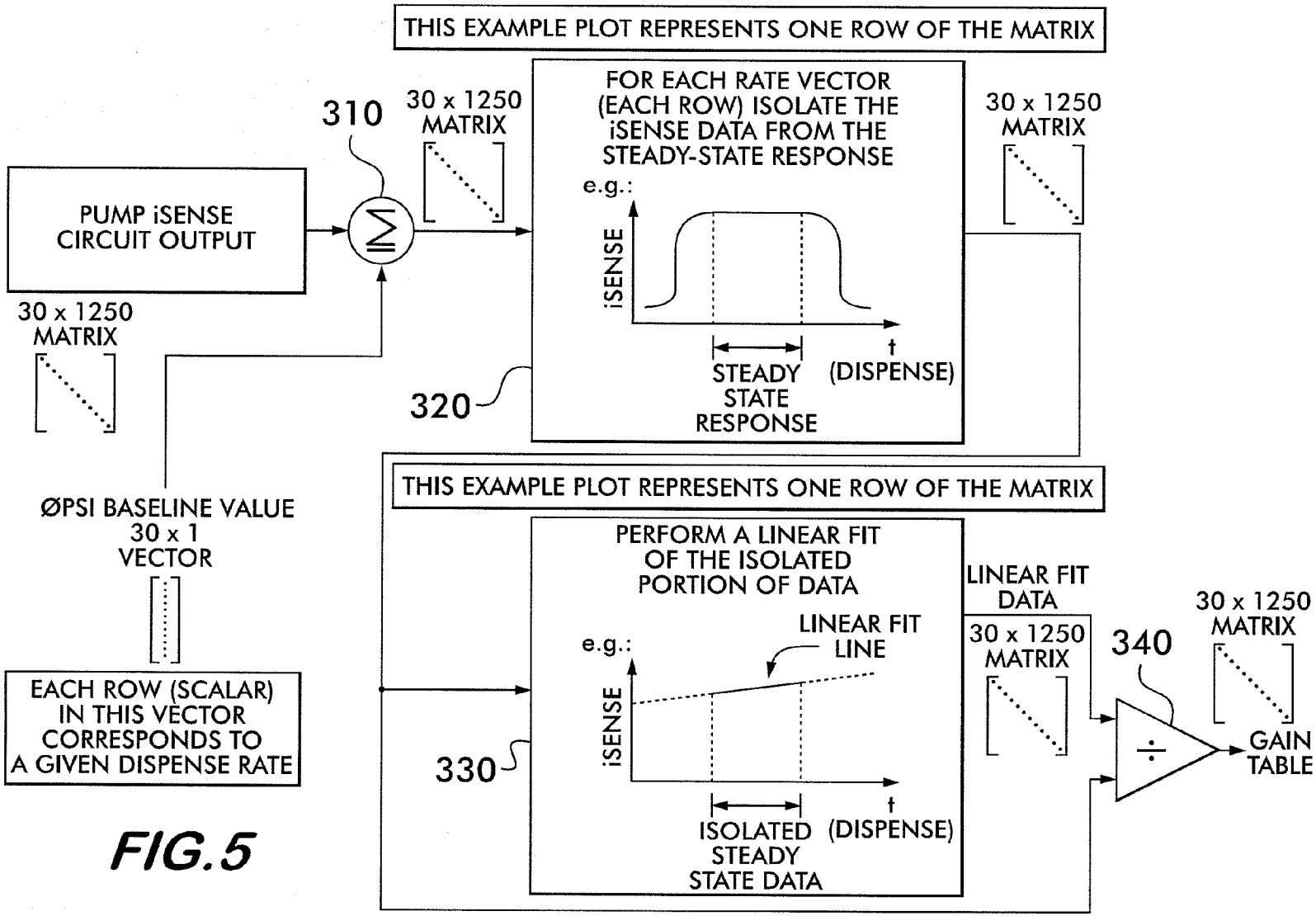
FIG. 5 is a flow diagram for deriving gain tables used to calculate pump pressure from motor current.
Figure 6:
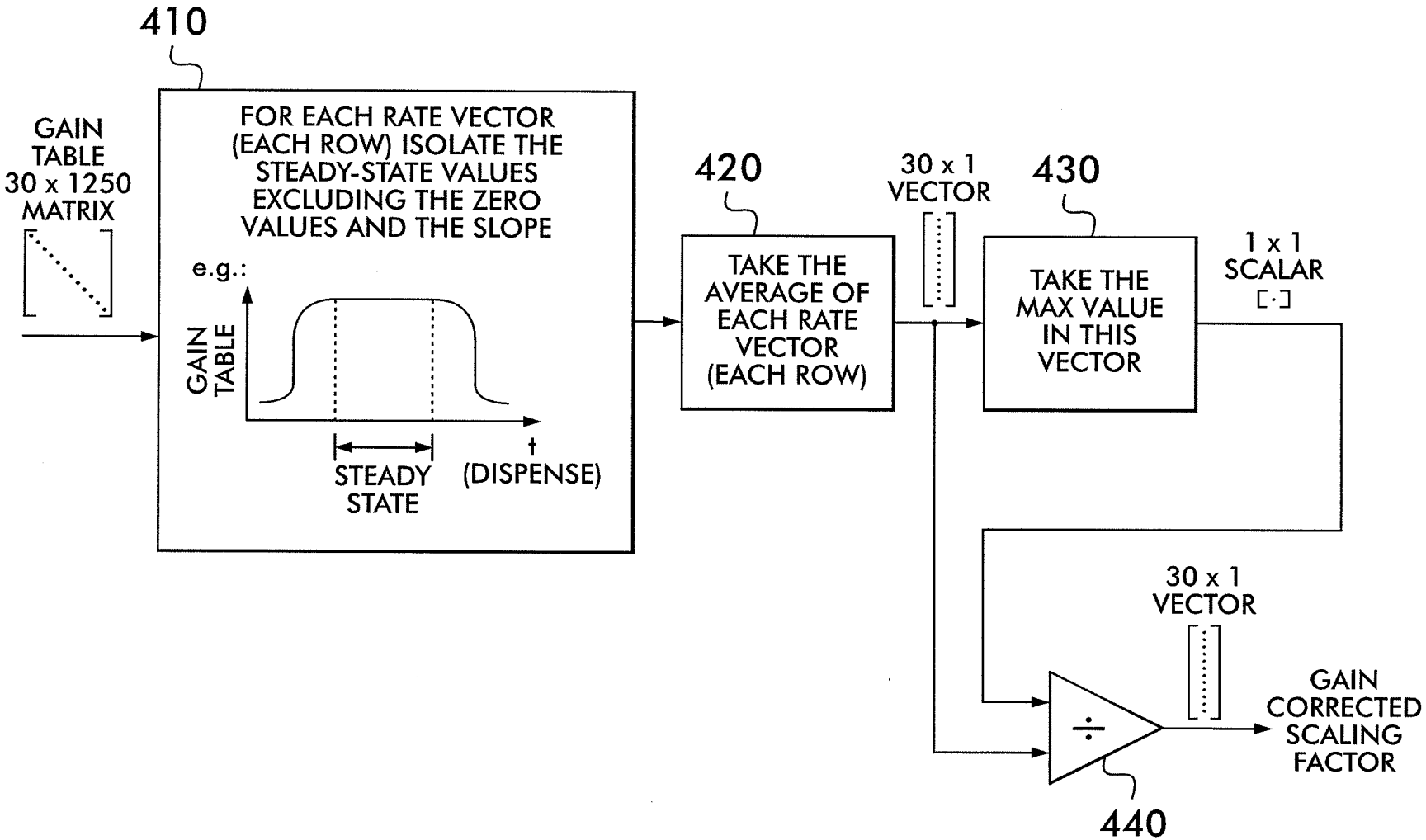
FIG. 6 is a flow diagram for deriving scale factors used to calculate pump pressure from motor current.

FIGS. 5 and 6 describe the process for generating the gain-corrected scaling factors used in scaling the motor current to pump pressure, and for creating a calibrated gain table with values for each of the 1250 sample measurements. In operation of the pump in a production process, the current values measured are scaled and compared to the calibrated table for the applicable flow rate. In this manner, it is possible to determine how the production process compares to the calibrated table values and whether the production process is sufficiently close to the calibrated values or if there are deviations from the calibrated values. Such deviations could indicate equipment failure or other system anomalies and if large enough would result in halting further processing of the materials in the particular production process for which the deviations occurred.

FIG. 5 is a flow diagram for creating a gain table that covers all of the applicable flow rates.

There are three sets of data that are obtained through a cycle test of a pump. The cycle test involves running the pump through an entire dispense for a set of 30 rates from 0.1 mL/s to 3.0 mL/s. These data are maintained in the pump memory as tables to be referenced to speed up the calculations. The three sets of tabular data are: 1) a zero psi reference baseline vector, 2) a gain table matrix and 3) a gain corrected scaling factor vector. For each of these three sets of data, each row corresponds to a specific dispense rate from 0.1 mL/s to 3.0 mL/s.

FIG. 5 is a flow diagram for creating a gain table for 30 different pump rates. At step 310, the 30×1250 matrix of current sense values (each row representing a different pump rate) is summed with a 30×1 baseline vector. Note that the procedure for obtaining the baseline vector is described in FIG. 7. At step 320, for each row of 1250 values, the steady state response is isolated. At step 330 a linear fit is performed for each of the isolated rows of current data. At step 340, the linear fit data is combined with the steady state data from step 320 to produce a single row of the gain table. This process is repeated for each of the flow rate rows.

FIG. 6 is a flow diagram for calculating scale factors for each of the dispense rates. At step 410 the steady state values for each row are isolated. The average of each rate vector for each row is calculated at step 420. This produces a 30×1 matrix of values. At step 430, the maximum value of the 30 values is found. At step 440, each of the 30 values in the matrix is divided by the maximum value to normalize the 30 values to a 30×1 matrix of gain corrected scale factors.

Figure 7:
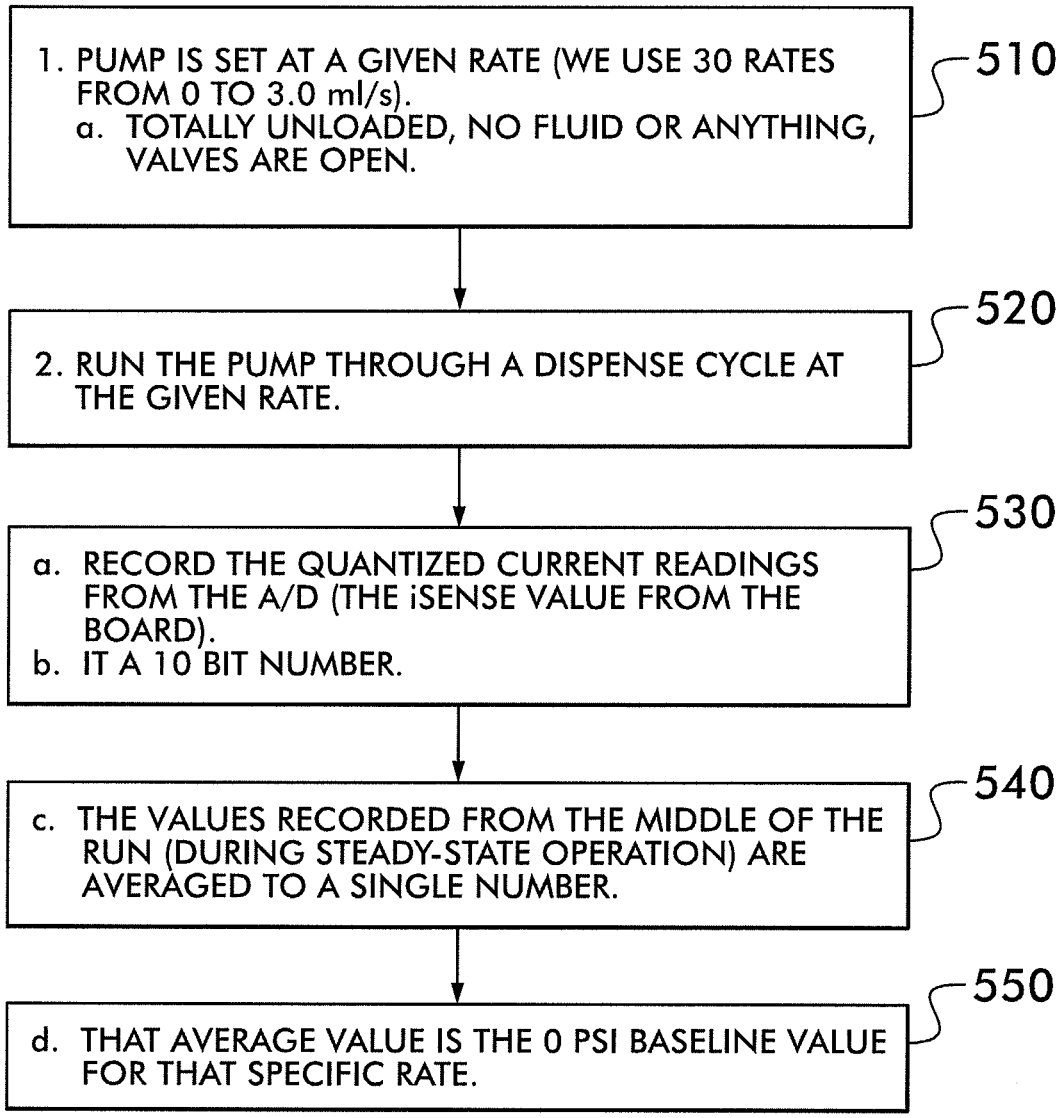
FIG. 7 is an exemplary process flow diagram for generating a 0 psi base line reference vector as applied in FIGS. 4-6.

FIG. 7 is a flow diagram for calculating a 0 psi baseline reference vector for each of the dispense rates. Note that this vector is used in the flow diagram shown in FIG. 5. At step 510, the pump is set to a predetermined rate, and is unloaded. At step 520, the pump is run through a dispense cycle at the predetermined rate. Step 530 involves recording quantized current readings over time during the pump dispense cycle. At step 540 the current readings from the steady state portion of the dispense cycle are averaged. At step 550, the average number is assigned to be the 0 psi baseline value for that predetermined dispense rate. During pump operation, the 0 psi baseline number is looked up based on the dispense rate and is subtracted from the input current values.

In an embodiment reduced to practice it was observed that as a pump is operated over time, small, short term variations in the amount of motor force necessary to produce the same pump pressure can occur. These variations are reflected in increased current sense measurements for the same pump pressure. These variations can affect the ultimate accuracy of the above-described process. Fortunately, since any short term changes in the mechanical pump assembly during the dispense are reflected during the recharge portion of the pumping cycle, further dispense accuracy can be obtained by using current samples, taken during, the recharge, to detect and correct any short term variations due to the mechanical pump assembly.

In an embodiment, after the pump dispense is complete and the gain corrected values have been placed into the dispense buffer, the pump will recharge. During the recharge, the raw current output samples are added together. At the end of the recharge, this running sum is divided by the number of total recharge current samples to obtain the average recharge current. This recharge average is divided by the recharge rate to obtain the normalized recharge average. The normalized recharge average is sorted into one of ten correction ranges, corresponding to ten different dispense correction factor indices. This index, added to the rate (0.1 though 3.0 ml/sec), comprises an index into the dispense correction table (30×10 elements). This dispense correction factor is added to every sample in the dispense profile buffer to complete the compensation.

Figure 8:
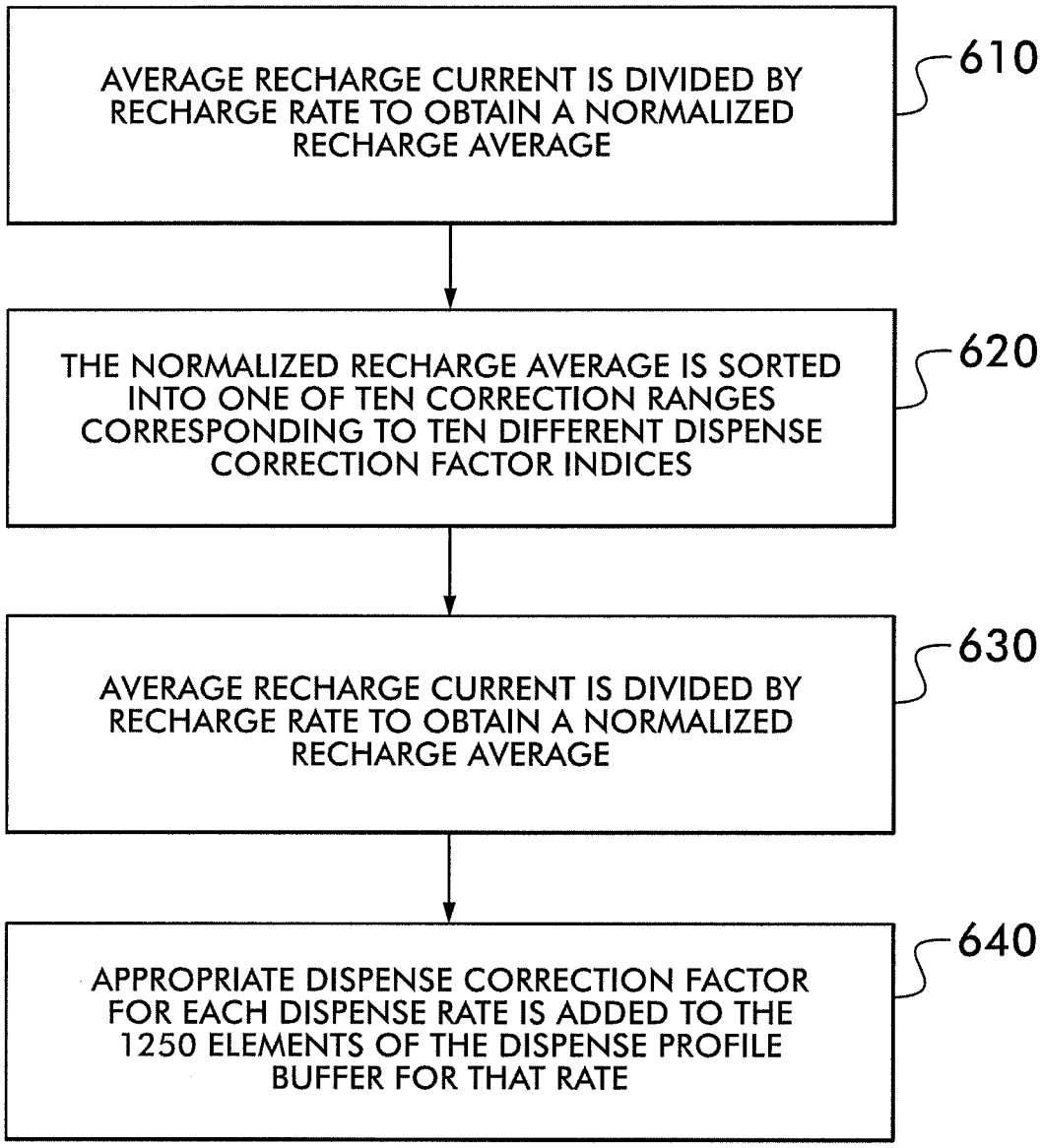
FIG. 8 is an exemplary process flow diagram for generating correction factors.

FIG. 8 is a flow diagram of steps to obtain a dispense compensation factor. At step 610 average recharge current is divided by recharge rate to obtain a normalize recharge average. At step 620, the normalized recharge average is sorted into one of ten correction ranges corresponding to ten different dispense correction factor indices. At step 630, a 30×10 dispense correction table is created with 10 possible correction factors for each of 30 dispense rates. At step 640, the appropriate dispense correction factor for each dispense rate is added to the 1250 elements of the dispense profile buffer for that rate.

The method used in FIGS. 4-8 to characterize pump pressure over time and to scale and adjust the motor current values is but one embodiment of the invention. Other approaches to modeling the motor/pump behavior over a process cycle and at differing operating conditions are within the scope of the invention. For example, instead of using one table value for each current sample at a predetermined time period, there could be more motor samples during a production run of the pump than there are table values. In this case, an interpolation between table values is use to determine expected current when the current measurement is made at a time between the times for which table values are recorded. In another example, instead of offsetting and line-fitting the current values to model the process, raw values can be used where there is more data space available.

One aspect of the invention is to determine if a motor driven process matches a predetermined profile over time by measuring motor current over time and comparing that current to a stored table of values for current in a desired profile for the process. Where there are a number of conditions in which the process can take place, an equivalent number of tables, one for each condition is stored. In a further embodiment, instead of one table for each condition (e.g. 30 tables for 30 flow rates) less tables could be used and interpolated values from two tables used for condition levels between the two tables. For example, if there are tables at 5 ml/s (milliliters per second) increments, and a production run was made at 22 ml/s one would interpolate table entries for the 20 and 25 ml/s tables.

As stated earlier, the invention is not limited to motor-driven pumps. The method described herein can be used to characterize any motor-driven process based on motor current and compare an actual production run of that process against a set of calibrated values for a desired result for the process.

Figure 9:
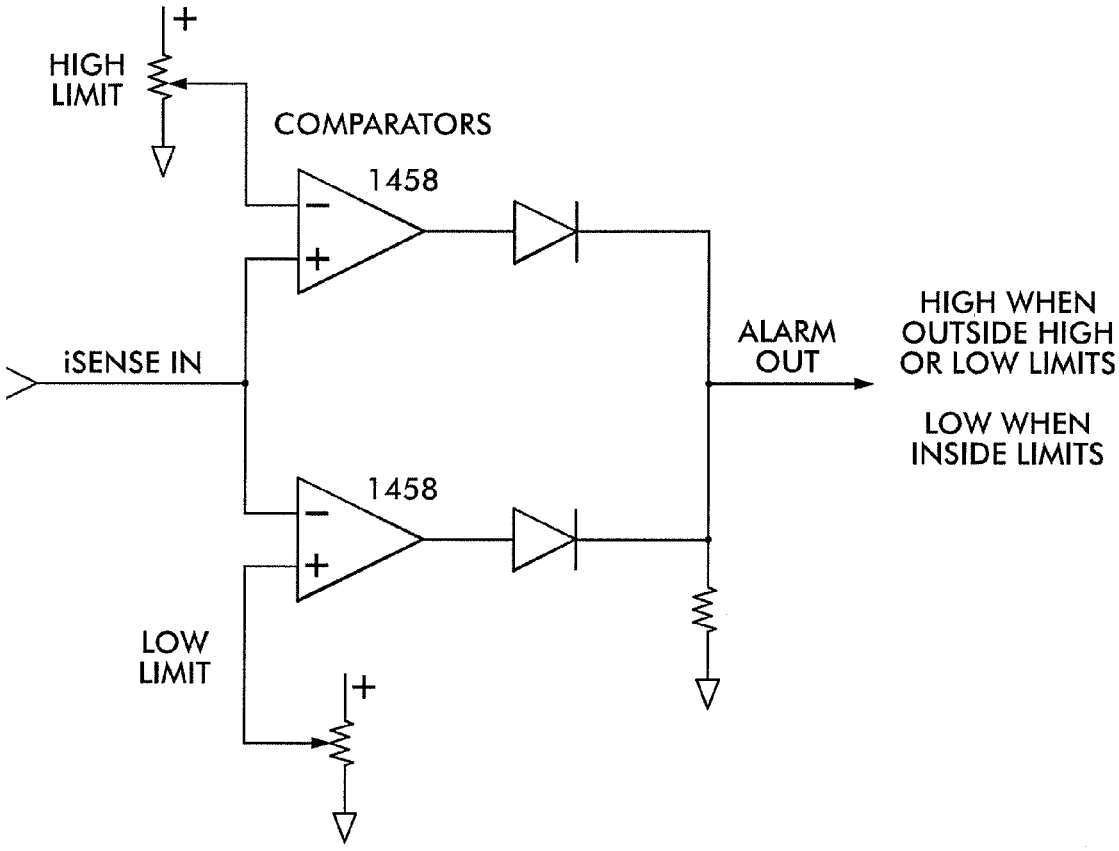
FIG. 9 is a schematic for an exemplary current sensing circuit.

In a further embodiment, shown in FIG. 9, instead of an using an analog to digital converter and digital processing, as described above, a window comparator configuration comprising two comparators 710, 720 may be used to sense H-bridge current 705. The window comparator produces a high level out put 730 when current is above or below predetermined limits. This embodiment can be used for lower resolution applications such as detecting when a motor is jammed, broken or overloaded. The upper and lower limits can be set to monitor an acceptable operating band and trigger an alarm when the limits are exceeded.

While the invention has been described in detail and with reference to specific examples thereof, it will be apparent to one skilled in the art that various changes and modifications can be made therein without departing from the spirit and scope thereof.

The invention claimed is:

1. A method for characterizing a motor-driven process having predefined first and second temporal process points taking place over a predetermined period of time, wherein the process output is related to motor torque, comprising:

measuring motor current at a plurality of discrete time periods during the predetermined period of time to create motor current values for a representative operation of the process;

storing said motor current values to create a benchmark for said representative operation;

measuring motor current at a plurality of discrete time periods during a second operation of the process operating between the first and second temporal process points to create a second data set of motor current values;

comparing said second data set with said benchmark to determine if said second operation is within a predetermined tolerance of said benchmark.

2. A conditioning circuit for conditioning voltage signals from at least two current sensing elements in a motor drive circuit, comprising:

a multi-input input integrator for integrating said voltage signals and an envelope detector for removing signal noise from said voltage signals.

3. A method for characterizing a motor-driven pumping process having predefined first and second temporal process points taking place over a predetermined period of time, wherein the process pressure is related to motor torque comprising:

measuring motor current at a plurality of discrete time periods during the predetermined period of time to create motor current values for a representative operation of the pumping process;

storing said motor current values to create a benchmark related to pump pressure over said predetermined period of time for said representative operation;

measuring motor current at a plurality of discrete time periods during a second operation of the pumping process operating between the first and second temporal processpoints to create a second data set of motor current values;

comparing said second data set with said benchmark to determine if said second pumping operation is within a predetermined tolerance of said benchmark.

4. The method of claim 1, wherein the first temporal process point is the beginning of a process and the second temporal process point is the end of said process.

5. The method of claim 3, wherein the first temporal process point is the beginning of a process and the second temporal process point is the end of said process.

* * * * *